US008292130B2

(12) United States Patent
Lemaner

(10) Patent No.: US 8,292,130 B2
(45) Date of Patent: Oct. 23, 2012

(54) PUMP FOR DISTRIBUTING LIQUID PRODUCT AND DISPENSER COMPRISING SUCH A PUMP

(75) Inventor: Francois Lemaner, La Vallee Montaure (FR)

(73) Assignee: Aptar France SAS, Le Neubourg (FR)

( * ) Notice: Subject to any disclaimer, the term of this patent is extended or adjusted under 35 U.S.C. 154(b) by 392 days.

(21) Appl. No.: 12/530,689

(22) PCT Filed: Mar. 10, 2008

(86) PCT No.: PCT/FR2008/050401

§ 371 (c)(1),
(2), (4) Date: Sep. 10, 2009

(87) PCT Pub. No.: WO2008/129187

PCT Pub. Date: Oct. 30, 2008

(65) Prior Publication Data

US 2010/0038383 A1 Feb. 18, 2010

(30) Foreign Application Priority Data

Mar. 12, 2007 (FR) ..... 07 53766

(51) Int. Cl.
*B65D 88/54* (2006.01)

(52) U.S. Cl. ..... 222/321.2; 222/321.9; 222/321.7; 222/341

(58) Field of Classification Search .... 222/321.1–321.9, 222/341

See application file for complete search history.

(56) References Cited

U.S. PATENT DOCUMENTS

| | | | | |
|---|---|---|---|---|
| 3,391,647 | A * | 7/1968 | Cooprider et al. | 417/456 |
| 4,089,442 | A * | 5/1978 | Hafele et al. | 222/321.2 |
| 4,189,064 | A * | 2/1980 | O'Neill et al. | 222/321.2 |
| 4,249,676 | A | 2/1981 | Beery | |
| 4,402,432 | A | 9/1983 | Corsette | |
| 4,938,392 | A * | 7/1990 | Su | 222/321.3 |

(Continued)

FOREIGN PATENT DOCUMENTS

DE 31 05 371 A1 12/1981

(Continued)

OTHER PUBLICATIONS

International Search Report of PCT/FR2008/050401 dated Sep. 12, 2008.

(Continued)

*Primary Examiner* — Kevin P Shaver
*Assistant Examiner* — Nicholas Weiss
(74) *Attorney, Agent, or Firm* — Sughrue Mion, PLLC

(57) ABSTRACT

A fluid dispenser pump (10) including a pump body (11) and a piston (20) that slides in leaktight manner in the pump body (11) between a rest position and an actuated position. The piston (20) is secured to an actuator rod (30) that extends axially out from the pump body (11). A ferrule (40) is mounted on the top edge (12) of the pump body (11), the ferrule (40) defining the rest position of the piston (20). The ferrule (40) co-operates in leaktight manner with the actuator rod (30) while the actuator rod (30) moves between the rest position and an intermediate position, and the ferrule (40) co-operates in non-leaktight manner with the actuator rod (30) while the actuator rod (30) moving between the intermediate position and the actuated position, so as to make it possible to vent the pump (10).

15 Claims, 3 Drawing Sheets

U.S. PATENT DOCUMENTS

| | | | | |
|---|---|---|---|---|
| 5,560,520 | A * | 10/1996 | Grogen | 222/321.2 |
| 5,738,250 | A * | 4/1998 | Gillingham et al. | 222/153.13 |
| 5,791,527 | A * | 8/1998 | Giuffredi | 222/321.9 |
| 6,006,949 | A * | 12/1999 | Foster et al. | 222/153.13 |
| 6,036,059 | A * | 3/2000 | VanBrocklin | 222/321.9 |
| 6,390,338 | B1 | 5/2002 | Baudin | |
| 7,503,466 | B2 * | 3/2009 | Ramet | 222/321.9 |
| 7,637,395 | B2 * | 12/2009 | Tseng | 222/321.9 |
| 2004/0144805 | A1 * | 7/2004 | Maner | 222/321.6 |
| 2005/0279770 | A1 | 12/2005 | Moretti | |
| 2007/0029347 | A1 * | 2/2007 | Le Maner | 222/321.2 |

FOREIGN PATENT DOCUMENTS

| | | |
|---|---|---|
| EP | 1 095 871 A1 | 5/2001 |
| EP | 1 466 669 A1 | 10/2004 |
| EP | 1 609 529 A1 | 12/2005 |

OTHER PUBLICATIONS

Action for Annulment for European Patent EP 2 139 605 B1, dated Oct. 31, 2011.

* cited by examiner

PUMP FOR DISTRIBUTING LIQUID PRODUCT AND DISPENSER COMPRISING SUCH A PUMP

The present invention relates to a fluid dispenser pump and to a dispenser including such a pump.

Fluid dispenser pumps are well known in the prior art. Various types exist, and in particular "atmospheric" pumps in which the suction created inside the reservoir by dispensing a dose of fluid is compensated by vent air penetrating into the device from the outside. In that type of pump, there is generally a ferrule that is engaged in the pump body and that co-operates in leaktight manner with the piston in the rest position, firstly so as to define the rest position of the piston, and secondly so as to close the pump in leaktight manner, thereby avoiding any risk of leakage, e.g. when the device on which the pump is assembled is stored upsidedown with the pump situated beneath the reservoir. This static sealing between the ferrule and the piston is fragile since, in general, it is constituted merely by annular contact between the sharp edge of the inside diameter of the ferrule and the cone of the piston. When stress is applied to the piston, e.g. to the actuator rod, sealing is quickly destroyed, with a few hundredths of a millimeter being sufficient to open the vent system of the pump, and thus lead to a risk of leakage if the device is stored on its side or upsidedown. In addition, in that type of pump, controlling the rest position of the pump, also known as the high dead point, can be difficult, since that position is defined by contact between the piston and the ferrule with the risk of one or the other of said parts becoming deformed as a result of use, thereby leading to a small change in the definition of said position. In addition, the snap-fastenable, crimpable, or screw-fastenable fastener ring used to fasten the pump on the reservoir should also co-operate in leaktight manner with the ferrule, and to do this a sealing gasket is generally provided. This can be disadvantageous from the point of view of the complexity of assembling the pump, and thus from the point of view of the cost of manufacturing and assembling the pump. Documents EP-1 466 669, EP-1 609 529, and U.S. Pat. No. 4,249,676 describe prior-art devices.

An object of the present invention is to provide a fluid dispenser pump that does not have the above-mentioned drawbacks.

An object of the present invention is to provide a fluid dispenser pump that substantially reduces the risk of leakage while the pump is in its rest position.

Another object of the present invention is to provide a fluid dispenser pump that makes it possible to define the rest position of the pump accurately and over a long period of time, even after said pump has been used many times.

Another object of the present invention is to provide a fluid dispenser pump that is simple and inexpensive to manufacture and to assemble.

The present invention thus provides a fluid dispenser pump comprising a pump body, a piston that slides in leaktight manner in said pump body between a rest position and an actuated position, said piston being secured to an actuator rod that extends axially out from said pump body, a ferrule being mounted on the top edge of said pump body, said ferrule defining the rest position of said piston, said ferrule co-operating in leaktight manner with the actuator rod while the actuator rod is moving between the rest position and an intermediate position, and said ferrule co-operating in non-leaktight manner with the actuator rod while the actuator rod is moving between said intermediate position and the actuated position, so as to make it possible to vent the pump, with said piston not being in contact with said ferrule, when in the rest position.

Advantageously, said actuator rod comprises a bottom portion of greatest diameter and a top portion of smallest diameter, said bottom and top portions being interconnected via a junction portion, said ferrule co-operating in leaktight manner with said bottom portion of greatest diameter while said actuator rod is moving between the rest position and the intermediate position, and said ferrule co-operating in non-leaktight manner with said top portion of smallest diameter while the actuator rod is moving between the intermediate position and the actuated position, said non-leaktight co-operation between the ferrule and the actuator rod making it possible to vent the pump.

Advantageously, between the rest position and the intermediate position, said ferrule co-operates in leaktight manner with the actuator rod via a contact zone that is elastically deformable, and that, at rest, has an inside diameter that is greater than the outside diameter of said top portion of smallest diameter of the actuator rod, and has an inside diameter that is less than the outside diameter of said bottom portion of greatest diameter of the actuator rod, such that said contact zone is elastically deformed outwards when it co-operates in leaktight manner with said bottom portion of greatest diameter.

Advantageously, said junction zone is frustoconical so as to make it easier for said contact zone of the ferrule to pass onto said bottom portion of greatest diameter.

Advantageously, said ferrule includes a shoulder, preferably of frustoconical shape, that is adapted to form an abutment with a junction portion, preferably of frustoconical shape, of the actuator rod, so as to define the rest position of the piston.

Advantageously, said ferrule comprises a radial flange that bears against the top end edge of the pump body, and an axial sleeve that extends inside said pump body, at least in part, and having a bottom end that forms a contact zone that co-operates with said actuator rod.

In a first variant embodiment, said radial flange supports a gasket that co-operates in leaktight manner with said ferrule and with a fastener ring that is adapted to fasten the pump on a reservoir containing the fluid to be dispensed.

In a second variant embodiment, said radial flange co-operates in leaktight manner with a fastener ring that is adapted to fasten the pump on a reservoir containing the fluid to be dispensed.

Advantageously, said radial flange includes a sealing profile on its top axial surface that co-operates in leaktight manner with the fastener ring.

Advantageously, on its radially outermost edge, said radial flange includes at least one sealing lip that co-operates in leaktight manner with the fastener ring.

Advantageously, said ferrule is made out of a material that is relatively flexible, such as a material comprising low-density polyethylene (LDPE).

The present invention also provides a fluid dispenser device comprising a reservoir containing fluid and a pump as described above, said pump being assembled on said reservoir by means of a fastener ring.

Other characteristics and advantages of the present invention appear more clearly from the following detailed description of several embodiments thereof, given by way of non-limiting example, and with reference to the accompanying drawings, and in which.

Figure 1:
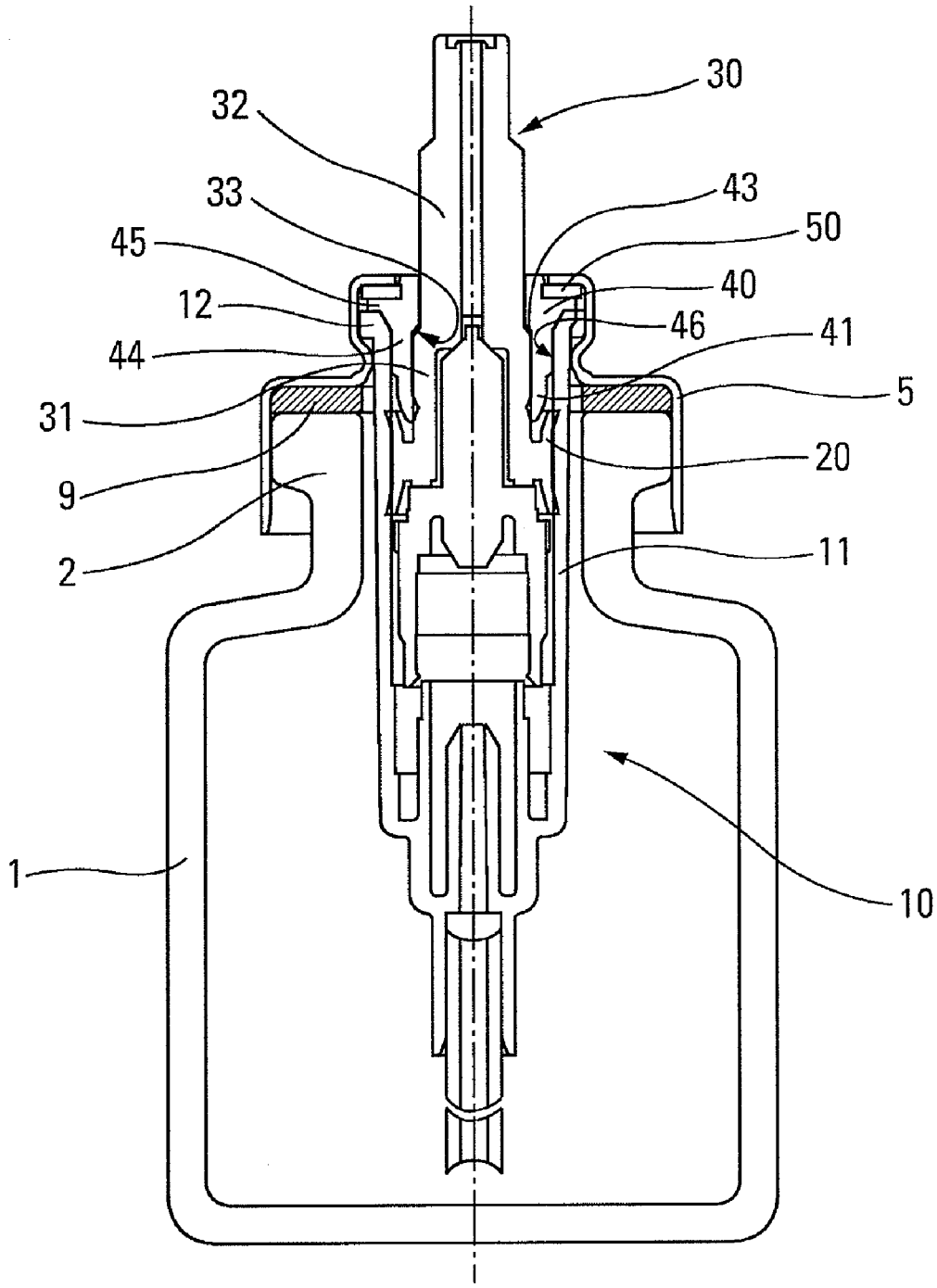
FIG. 1 is a diagrammatic section view of a fluid dispenser device including a fluid dispenser pump constituting an advantageous embodiment of the present invention, in its rest position.
Figure 2:
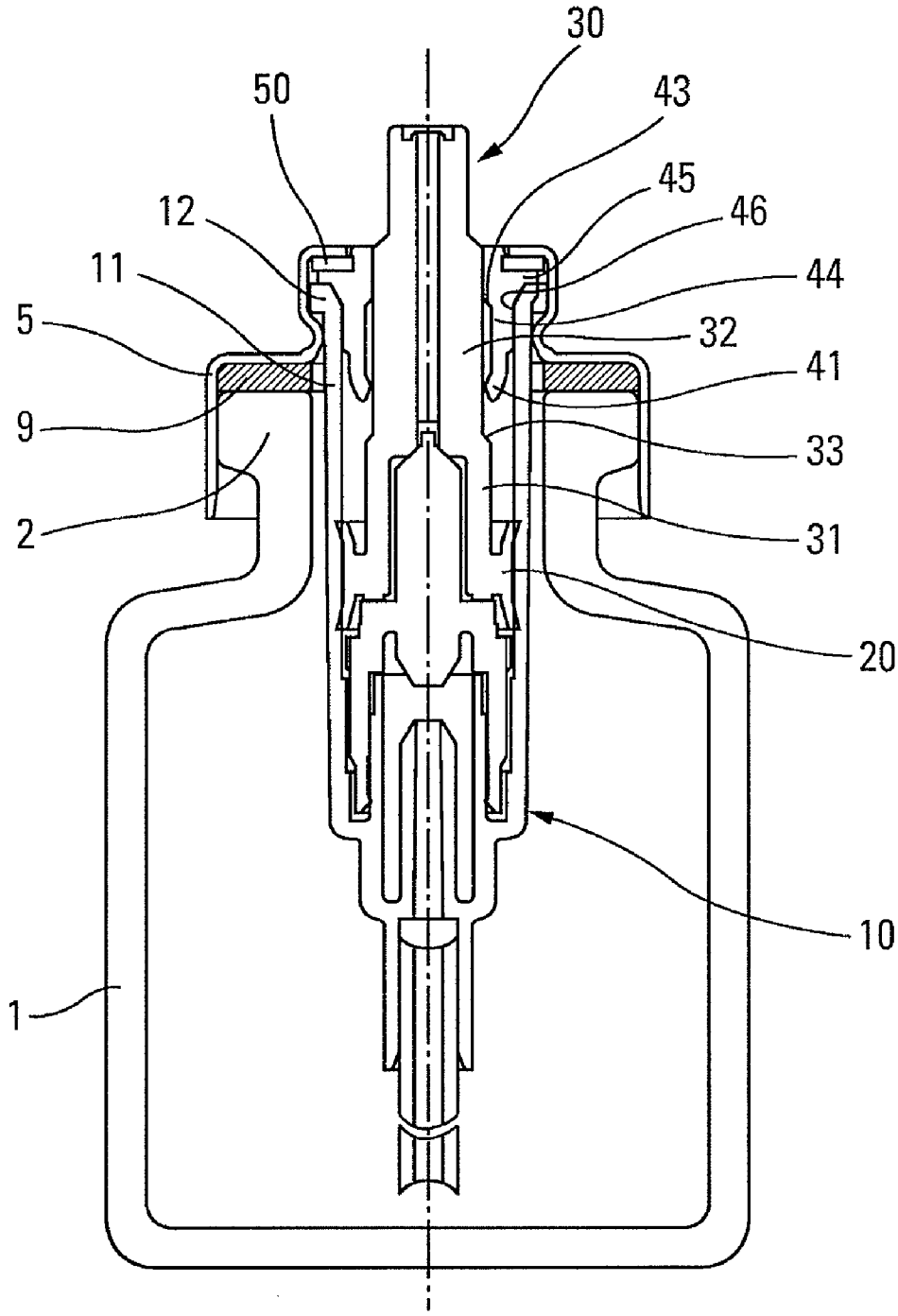
FIG. 2 is a view similar to the view in FIG. 1, in the actuated position of the pump.

FIGS. 1 and 2 show a fluid dispenser device constituting an advantageous embodiment of the present invention. The device comprises a reservoir 1 provided with a neck 2, a pump 10 being assembled on said neck 2 of the reservoir 1 by means of a fastener ring 5, preferably with a sealing gasket 9 known as a neck gasket interposed therebetween. The pump includes a pump body 11 provided with a top end edge 12. A piston 20 slides in leaktight manner inside said pump body 11 on each actuation, so as to dispense a dose of composition from the reservoir 1. The internal structure of the pump is not described in greater detail below, since the present invention applies to any type of pump, and is not limited in any way by the specific characteristics of the pump given by way of example in FIGS. 1 and 2. In conventional manner, the piston 20 is secured, in particular integrally, as shown in the drawings, with an actuator rod 30 on which there is assembled a dispenser head or pusher (not shown) on which the user presses directly or indirectly so as to actuate the pump. A ferrule 40 is assembled inside the pump body 11, and co-operates with the piston 20 so as to define the rest position of said piston. In the embodiment in FIGS. 1 and 2, the ferrule 40 supports a sealing gasket 50 that is adapted to provide sealing between the ferrule 40 and the fastener ring 5. The fastener ring 5 may be of any type, in particular it may be crimpable as shown in the drawings, but it could also be snap fastenable, screw fastenable, or any other appropriate fastener ring.

The pump shown is an "atmospheric" pump, i.e. in its rest position, it is leaktight relative to the atmosphere, but during actuation, the composition dispensed from the reservoir must be replaced by a corresponding quantity of air coming in from the outside, such that a vent system is provided in the pump.

In the invention, the ferrule 40 co-operates in leaktight manner with the actuator rod 30 while the actuator rod is moving between the rest position shown in FIG. 1 and an intermediate position, and said ferrule 40 ceases to co-operate in leaktight manner with the actuator rod 30 between said intermediate position and the actuated position shown in FIG. 2. Thus, when the co-operation between the ferrule 40 and the actuator rod 30 is no longer leaktight, the vent system is open in conventional manner.

In the embodiment shown in FIGS. 1 and 2, the ferrule 40 includes a radial flange 45 that bears against the top edge 12 of the pump body 11. The ferrule 40 also includes an axial sleeve 44 that penetrates inside the pump body, at least in part. In the position shown in FIGS. 1 and 2, a portion of the axial sleeve 44, preferably its bottom end, forms a contact zone 41 that is adapted to co-operate in leaktight manner with said actuator rod 30 between the rest position and the intermediate position, as described above. The actuator rod 30 advantageously comprises a bottom portion 31 of greatest diameter, and a top portion 32 of smallest diameter, said bottom and top portions 31, 32 being interconnected via a junction portion 33 that is preferably frustoconical. Thus, between the rest position and the intermediate position, the contact zone 41 of the ferrule 40 co-operates in leaktight manner with said bottom portion 31 of greatest diameter, whereas when the contact zone 41 reaches the intermediate position, it is thus situated at the junction zone 33, and it then no longer co-operates in leaktight manner with the actuator rod at the top portion 32 of smallest diameter, enabling the vent system to open. In order to make it easier for the contact zone 41 to pass onto the portion 31 of greatest diameter, the junction portion 33 is preferably frustoconical.

Thus, at the start of actuation, when the pump leaves its rest position shown in FIG. 1, the contact zone 41 of the ferrule slides in leaktight manner against the bottom portion 31 of greatest diameter of the actuator rod. It is only when the actuator rod reaches the intermediate position, that can advantageously be relatively close to the actuated position, that the vent system is open, when the contact zone 41 of the ferrule no longer co-operates in leaktight manner with the actuator rod 30.

The ferrule 40 preferably includes a shoulder 43 that is preferably frustoconical, that is preferably of shape that corresponds to the junction portion 33 of the actuator rod, and that is adapted to form an abutment with the junction portion 33 of the actuator rod 30, thereby defining the rest position of the piston 20. The rest position shown in FIG. 1 can thus be defined very accurately, and in said rest position there is no longer any contact between the piston 20 and the ferrule 40. There is thus no longer any risk of deformation of the piston 20, even only a small amount of deformation, causing a change in the rest position of the pump. On the contrary, and as can be seen more clearly in FIGS. 3, 4, and 5, the cone against cone co-operation of the junction portion 33 of the actuator rod 30 with the shoulder 43 of the ferrule 40 makes it possible to define a clear and precise rest position of the pump, and this continues even after said pump has been used many times.

The outside surface 46 of the axial sleeve 44 of the ferrule 40 co-operates in non-leaktight manner with the inside of the pump body 11. In particular, the vent path can flow between the ferrule and the pump body, then around the top edge of the pump body, then between the outside of the pump body and the fastener ring, and finally into the reservoir. For example, the outside surface 46 and the bottom surface of the radial flange 45 can include a vent groove.

Advantageously, the sealing contact zone 41 is elastically deformable, and at rest, i.e. in a non-stressed position that corresponds to the actuated position of the pump shown in FIG. 2, it includes an inside diameter that is greater than the outside diameter of the top portion 32 of smallest diameter of the actuator rod 30. This is visible in FIG. 2, and thus makes it possible to let air pass between the contact zone 41 and the actuator rod when said actuator rod is situated in the non-leaktight co-operation position, i.e. between the intermediate position and the actuated position of the pump. However, the inside diameter of the contact zone 41 is preferably less than the outside diameter of the bottom portion 31 of greatest diameter of the actuator rod 30. Thus, when said contact zone 41 co-operates with said bottom portion 31, it is elastically stressed or deformed outwards, such that sealing is even better when it co-operates with the bottom portion 31 of greatest diameter.

In a variant, the actuator rod 30 could be of outside diameter that is constant over the actuation stroke, but includes one or more grooves, advantageously axial grooves, where co-operation between the actuator rod and the ferrule is no longer leaktight. Other variants can also be envisaged when an intermediate position is defined in the actuation stroke, before which the ferrule co-operates in leaktight manner with the rod, and after which there is no longer any sealing.

Figure 3:
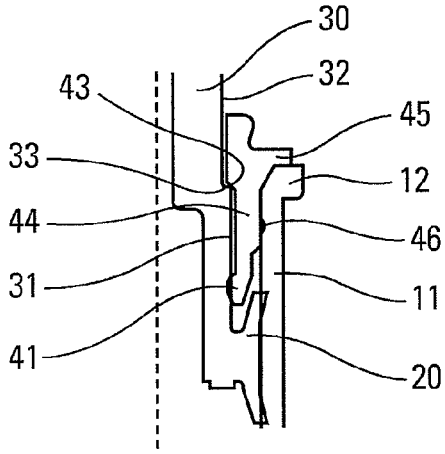
FIG. 3 is a view of a detail showing the co-operation between the ferrule and the actuator rod, in the rest position of the pump, constituting a first embodiment of the invention.

FIG. 3 shows a view of a detail of the pump shown in FIGS. 1 and 2.

Figure 4:
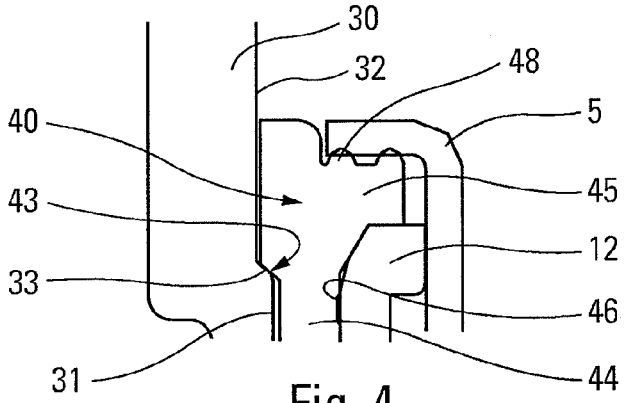
FIG. 4 is a view similar to the view in FIG. 3, showing another variant embodiment of the present invention.

FIG. 4 shows another variant embodiment in which the gasket 50 is not provided between the ferrule and the fastener ring 5. In this variant, it is the radial flange 45 of the ferrule 40 that, on its top axial surface, includes a sealing profile that co-operates in leaktight manner with the fastener ring 5. The sealing profile can comprise one or more beads, as shown in the figure, and could take any appropriate shape in order to provide sealing.

Figure 5:
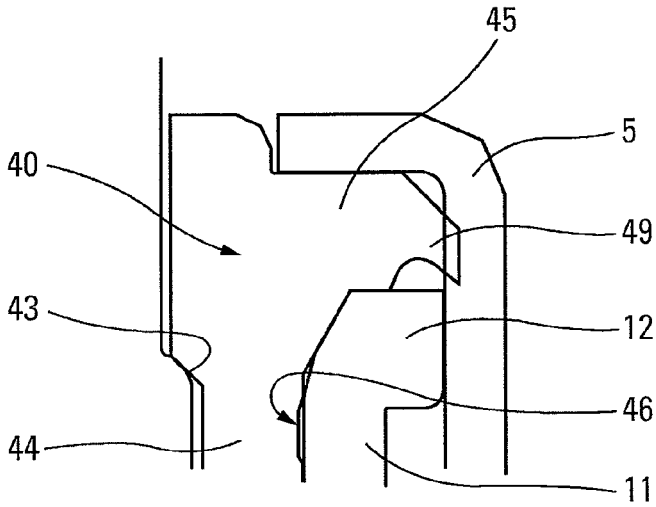
FIG. 5 shows still another variant embodiment of the present invention.

FIG. 5 shows another variant embodiment in which it is the radially outermost edge of the radial flange 45 of the ferrule 40 that includes at least one sealing lip 49 that is adapted to co-operate in leaktight manner with the fastener ring 5. In this embodiment also, other sealing profiles could be provided at this location.

It is advantageous to make the ferrule out of a material that is relatively flexible, making it possible to provide good sealing, e.g. a material comprising LDPE. The use of this material is advantageous in particular for enabling sealing to be provided at the contact zone 41 when said contact zone co-operates in leaktight manner with the actuator rod, and in particular for enabling said contact zone to deform in an embodiment in which it is of dimensions that are less than the bottom portion 31 of greatest diameter of the actuator rod 30. LDPE also promotes sealing with the fastener ring in the variants in FIGS. 4 and 5.

Embodiments without gasket 50 are also advantageous in that they make it possible to improve the accuracy with which the fastener ring is positioned relative to the pump, as a result of the smaller axial compressibility associated with the absence of the gasket.

Although the present invention is described above with reference to several variant embodiments thereof, it is clear that any useful modification could be applied thereto by a person skilled in the art, without going beyond the ambit of the present invention, as defined by the accompanying claims.

The invention claimed is:

1. A fluid dispenser pump comprising a pump body; a piston that slides in leaktight manner in said pump body between a rest position and an actuated position, said piston secured to an actuator rod that extends axially out from said pump body; a ferrule mounted on a top edge of said pump body, said ferrule defines the rest position of said piston; said ferrule co-operates in leaktight manner with the actuator rod while the actuator rod moves the piston between the rest position and an intermediate position, and said ferrule co-operates in non-leaktight manner with the actuator rod while the actuator rod (30) moves between said intermediate position and the actuated position, so as to enable the pump to be vented, said piston not being in contact with said ferrule, when in the rest position; and said ferrule comprises a radial flange that bears against the top end edge of the pump body and an axial sleeve that extends inside said pump body, at least in part, and having a bottom end that forms a contact zone that co-operates with said actuator rod.

2. The pump according to claim 1, in which said actuator rod comprises a bottom portion of greatest diameter and a top portion of smallest diameter, said bottom and top portions being interconnected via a junction portion, said ferrule co-operating in leaktight manner with said bottom portion of greatest diameter while said actuator rod is moving between the rest position and the intermediate position, and said ferrule co-operating in non-leaktight manner with said top portion of smallest diameter while the actuator rod is moving between the intermediate position and the actuated position, said non-leaktight co-operation between the ferrule and the actuator rod making it possible to vent the pump.

3. The pump according to claim 2, in which said ferrule, between the rest position and the intermediate position, co-operates in leaktight manner with the actuator rod via a contact zone that is elastically deformable, and that, at rest, has an inside diameter that is greater than the outside diameter of said top portion of smallest diameter of the actuator rod, and has an inside diameter that is less than the outside diameter of said bottom portion of greatest diameter of the actuator rod, such that said contact zone is elastically deformed outwards when it co-operates in leaktight manner with said bottom portion of greatest diameter.

4. The pump according to claim 3, in which said junction zone is frustoconical so as to make it easier for said contact zone of the ferrule to pass onto said bottom portion of greatest diameter.

5. The pump according to claim 1, in which said ferrule includes a shoulder adapted to form an abutment with a junction portion, preferably of frustoconical shape, of the actuator rod, so as to define the rest position of the piston.

6. The pump according to claim 1, in which said radial flange supports a gasket that co-operates in leaktight manner with said ferrule and with a fastener ring that is adapted to fasten the pump on a reservoir containing the fluid to be dispensed.

7. The pump according to claim 1, in which said radial flange co-operates in leaktight manner with a fastener ring that is adapted to fasten the pump on a reservoir containing the fluid to be dispensed.

8. The pump according to claim 7, in which said radial flange includes a sealing profile on its top axial surface that co-operates in leaktight manner with the fastener ring.

9. The pump according to claim 7, in which, on its radially outermost edge, said radial flange includes at least one sealing lip that co-operates in leaktight manner with the fastener ring.

10. The pump according to claim 1, in which said ferrule is made out of a material that is relatively flexible.

11. The fluid dispenser device comprising a reservoir containing fluid and a pump according to claim 1, said pump being assembled on said reservoir by means of a fastener ring.

12. The pump according to claim 5, wherein the shoulder has a frustoconical shape.

13. The pump according to claim 10, wherein the material comprises low-density polyethylene.

14. A fluid dispenser pump, comprising:

a pump body;

a piston that slides in a leaktight manner in the pump body between an initial position and a final position and passing through an intermediate position;

an actuator rod secured to the piston and movable with the piston;

a ferrule mounted on a top edge of the pump body;

the ferrule co-operates in a leaktight manner with the actuator rod while the actuator rod moves the piston between the initial position and the intermediate position;

the ferrule co-operates in a non-leaktight manner with the actuator rod while the actuator rod moves the piston between the intermediate position and the final position, so as to vent the pump; and the ferrule comprises a radial flange that bears against the top end edge of the pump body and an axial sleeve that extends inside said pump body, at least in part, and having a bottom end that contacts and co-operates with the actuator rod; wherein the piston is not in contact with the ferrule when in the initial position, and wherein the initial position is a rest position of the piston and the ferrule comprises an abutment against which a portion of the actuator rod rests.

15. The pump according to claim 14, wherein the actuator rod comprises a bottom portion of larger diameter and a top portion of smaller diameter; the ferrule co-operates in the leaktight manner with the bottom portion while said actuator rod moves between the initial position and the intermediate position; and the ferrule co-operates in the non-leaktight manner with the top portion while the actuator rod moves between the intermediate position and the final position, the non-leaktight co-operation between the ferrule and the actuator rod creating a vent.

* * * * *